US006715640B2

(12) United States Patent
Tapphorn et al.

(10) Patent No.: US 6,715,640 B2
(45) Date of Patent: Apr. 6, 2004

(54) POWDER FLUIDIZING DEVICES AND PORTABLE POWDER-DEPOSITION APPARATUS FOR COATING AND SPRAY FORMING

(75) Inventors: Ralph M. Tapphorn, Goleta, CA (US); Howard Gabel, Santa Barbara, CA (US)

(73) Assignee: Innovative Technology, Inc., Goleta, CA (US)

( * ) Notice: Subject to any disclaimer, the term of this patent is extended or adjusted under 35 U.S.C. 154(b) by 89 days.

(21) Appl. No.: 10/189,922

(22) Filed: Jul. 3, 2002

(65) Prior Publication Data

US 2003/0006250 A1 Jan. 9, 2003

Related U.S. Application Data

(60) Provisional application No. 60/304,147, filed on Jul. 9, 2001.

(51) Int. Cl.[7] ..... B05B 7/14

(52) U.S. Cl. ..... 222/52; 222/77; 222/199

(58) Field of Search ..... 222/52, 71, 77, 222/167, 189.06, 195, 196, 199, 200

(56) References Cited

U.S. PATENT DOCUMENTS

| | | | | | |
|---|---|---|---|---|---|
| 2,921,713 A | | 1/1960 | Zanotto et al. | | |
| 3,618,828 A | | 11/1971 | Schinella | | |
| 4,071,151 A | * | 1/1978 | Farber | 414/187 | |
| 4,579,482 A | | 4/1986 | Gastaldi et al. | | |
| 4,708,534 A | | 11/1987 | Gallant | | |
| 5,327,947 A | * | 7/1994 | McGregor | 141/71 | |
| 5,656,325 A | | 8/1997 | Wallace | | |
| 5,906,294 A | * | 5/1999 | Ikeya et al. | 222/55 | |

* cited by examiner

*Primary Examiner*—Gene Mancene
*Assistant Examiner*—Patrick Buechner
(74) *Attorney, Agent, or Firm*—Lyon & Harr, LLP; Richard T. Lyon

(57) ABSTRACT

The invention relates to a powder-fluidizing and feeding device for use with coating and spray forming nozzles and guns. The device includes novel provisions for controlling and feeding powder from a hopper to a vibrating bowl, for heating and vibrating powders in the hopper to dissipate agglomeration and clumping of the powder, and for metering powders from a vibrating bowl to the spray nozzles and guns using a feedback control derived from powder mass loss rate measurements. The device is particularly useful for feeding ultra-fine and nanoscale particles, which are difficult to feed uniformly with the prior art of conventional powder feeders.

20 Claims, 12 Drawing Sheets

POWDER FLUIDIZING DEVICES AND PORTABLE POWDER-DEPOSITION APPARATUS FOR COATING AND SPRAY FORMING

CROSS-REFERENCE TO RELATED APPLICATIONS

This application claims the benefit of a previously filed provisional patent application Serial No. 60/304,147, filed on Jul. 9, 2001.

BACKGROUND

1. Technical Field

The present invention relates to various powder-fluidizing and feeding devices for use with coating and spray forming nozzles and guns. The invention discloses new techniques for feeding ultra-fine and nanoscale particles, which are difficult to feed uniformly with the prior art of conventional powder feeders.

2. Background Art

The powder feeder disclosed in U.S. Pat. No. 3,618,828 issued to Schinella uses a vibrating structure to move powder from a receiving surface along a feeding surface to a discharge channel. The primary benefit of this type of powder feeder over prior art is uniform feeding of the powder feedstock without inducing pulsation caused by turbulence in the carrier gas flow. In addition, this type of feeder permits metering of the powder independent of the carrier gas flow rate and properties. The patent further describes the use of a hopper with an outlet channel and a hemispherical cup for metering powder (under the influence of gravity) onto the feeding surface through a smaller port than the outlet channel. The vibratory drive imparts rotary motion to the feeding surface for moving the powder in an outward spiral path along the feeding surface from the receiving surface to the discharge channel. The spacing between the port of the hemispherical cup and the receiving surface is less than the flow control dimension of the port. The feeder structure and hopper of U.S. Pat. No. 3,618,828 is disposed in a chamber for entraining the powder in a carrier gas fed through the discharge channel.

The primary limitation of the powder feeder disclosed in U.S. Pat. No. 3,618,828 is that uniformity of powder metering is highly dependent on the particle size and agglomeration characteristics of the powder. This is particularly true for ultra-fine and nanoscale powders with particle diameters of less than 10 micrometers. For highly agglomerating powders, the hemispherical cup becomes plugged preventing feed from the hopper to the receiving surface. For smooth flowing powders, there is a tendency under the influence of gravity to dump large quantities of powder in an uncontrolled manner onto the receiving surface. Particularly, once powder flow is initiated, uncontrollable feed frequently occurs through all ports and openings in the hemispherical cup resulting in an overflow condition onto the receiving surface.

Feeding of nanometer size particles is considerably more difficult because of the agglomerating aspects ascribed to Van der Waals forces (Handbook of Physics and Chemistry, 68 edition, CRC Press, E-67) acting between the particles. Prior art for dispensing and dispersing nanometer size particles has primarily been limited to colloidal suspensions.

Conventional powder feeding units such as that disclosed in U.S. Pat. No. 4,808,042 to Muehlberger, et al., U.S. Pat. No. 4,740,112 to Muehlberger, et al., U.S. Pat. No. 4,726,715 to Steen et al., U.S. Pat. No. 4,4,561,808 to Spaulding, et al. or in U.S. Pat. No. 4,3,565,296 to Brush, et al., all have difficulty uniformly feeding ultra fine powder. These feeders tend to induce pulsation at low feed rates due to agglomeration or are not able to inject powders into high-pressure guns or nozzles.

SUMMARY

The present invention relates to various powder-fluidizing and feeding devices for use with coating and spray forming nozzles and guns. The invention discloses new techniques for feeding ultra-fine and nanoscale particles, which are difficult to feed uniformly with the prior art of conventional powder feeders. The present invention allows powders to be fed into conventional coating and spray forming nozzles and guns, but more importantly into choked supersonic nozzles such as those disclosed in U.S. Pat. No. 5,795,626 issued to Gabel and Tapphorn, U.S. Pat. No. 6,074,135 issued to Tapphorn and Gabel, and friction compensated sonic nozzles disclosed in U.S. patent application Ser. No. 10/116,812 filed by Tapphorn and Gabel on Apr. 5, 2002. These choked nozzles require a high nozzle-inlet pressure which precludes uniform injection of powders using conventional powder feeders. The attribute of the invented powder-fluidizing device that permits injection into high inlet pressure nozzles is powder feeding that is independent of the gas mass flow characteristics. Thus, the powder fluidizing gas can be maintained at a sufficient pressure and flow rate to inject into a nearly isostatic nozzle inlet pressure, while powder is independently metered and entrained into the powder fluidizing gas.

Improvements to the powder-feeding concept, disclosed in U.S. Pat. No. 3,618,828, include sieve plates mounted within a hopper for precise metering of powder into a vibrating bowl. Powder is metered through the sieve plates by a hopper vibrator that is controlled by a level sensor mounted in the vibrating bowl. Other means for metering the powder through conventional pinch, iris, and cone valves are included as a means of metering powders from the hopper into the vibrating bowl. A funnel tube at the base of the hopper extends down into the vibrating bowl to direct the powder agitated through the sieve plates into the vibrating bowl. The funnel tube restricts powder fuming to a small confined volume within the funnel tube as the powder drops to the vibrating bowl surface. This technique eliminates any coupling between the vibrating bowl and the base structure that may dampen or perturb the vibration intensity during operation. Other improvements to the prior art include a means for heating and vibrating powders in the hopper to dissipate agglomeration and clumping of the powder, and methods for improving the precision and accuracy of metering powders from a vibrating bowl through a spiral-ramp groove and feedback control derived from mass loss or particle feed rate measurements.

This invention also relates to several embodiments of portable powder deposition devices for deposition and consolidation of powder particles using friction compensated sonic nozzles such as those disclosed in the aforementioned U.S. patent application Ser. No. 10/116,812 filed by Tapphorn and Gabel on Apr. 5, 2002 or supersonic nozzles as disclosed in U.S. Pat. No. 5,795,626 issued to Gabel and Tapphorn, and U.S. Pat. No. 6,074,135 issued to Tapphorn and Gabel.

DESCRIPTION OF THE DRAWINGS

The specific features, aspects, and advantages of the present invention will become better understood with regard to the following description, appended claims, and accompanying drawings where:

DETAILED DESCRIPTION OF THE PREFERRED EMBODIMENTS

In the following description of the preferred embodiments of the present invention, reference is made to the accompanying drawings, which form a part hereof, and in which is shown by way of illustration specific embodiments, which the invention may be practiced. It is understood that other embodiments may be utilized and structural changes may be made without departing form the scope of the present invention.

In general, the present invention relates to various powder-fluidizing and feeding devices for use with coating and spray forming nozzles and guns. The invention discloses new techniques for feeding ultra-fine and nanoscale particles, which are difficult to feed uniformly with the prior art of conventional powder feeders. Improvements to the powder-feeding concept of U.S. Pat. No. 3,618,828 issued to Schinella are disclosed in this invention. These improvements include apparatus and methods for controlling and feeding powder from a hopper to a vibrating bowl, for heating and vibrating powders in the hopper to dissipate agglomeration and clumping of the powder, and for improving the precision and accuracy of metering powders from a vibrating bowl through feedback control derived from mass loss or particle feed rate measurements.

This invention also relates to portable powder deposition devices for deposition and consolidation of powder particles using friction compensated sonic nozzles such as those disclosed in the aforementioned U.S. patent application Ser. No. 10/116,812 filed by Tapphorn and Gabel on Apr. 5, 2002.

Figure 1:
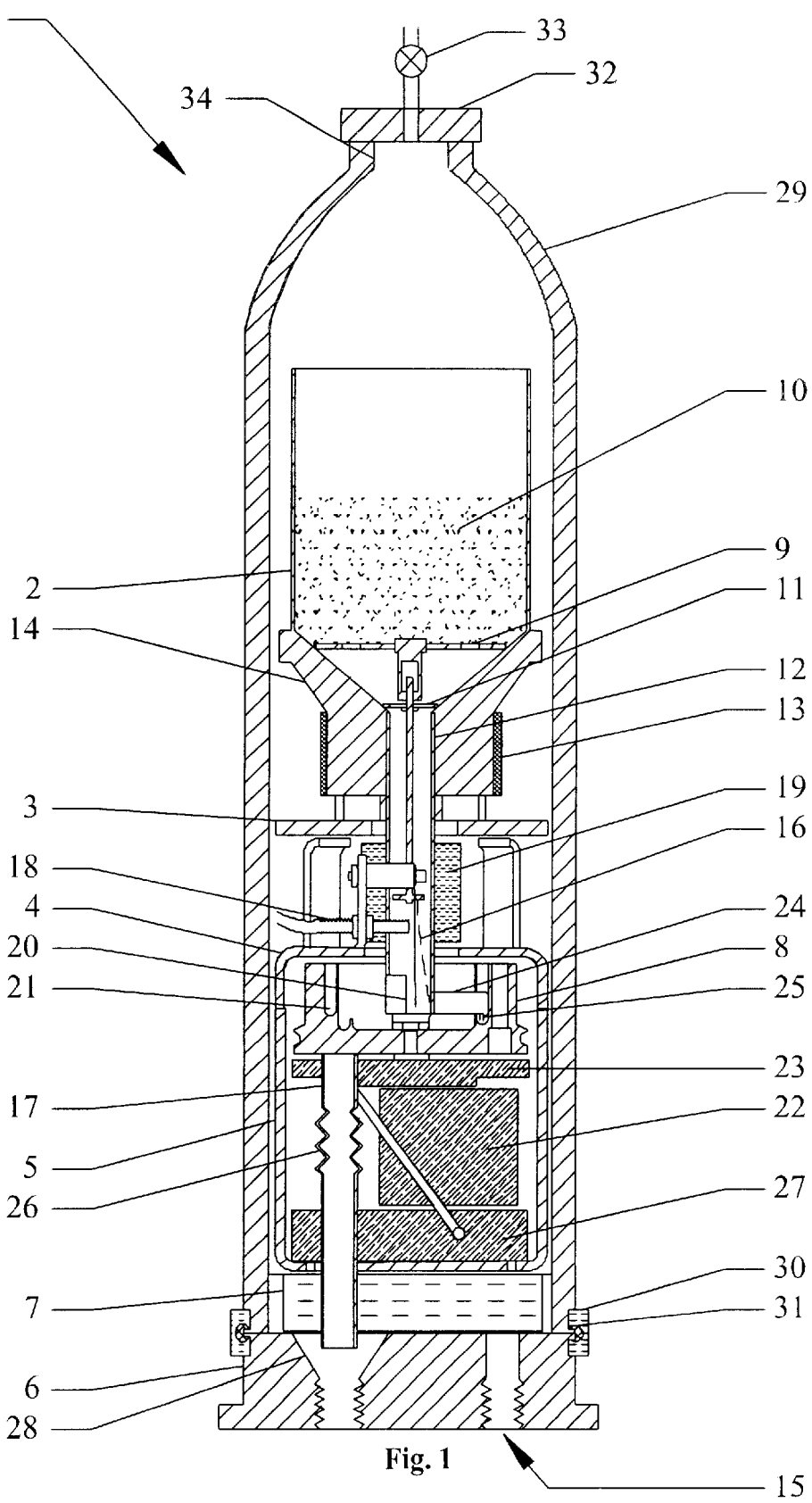
FIG. 1. Cross-section view of the powder-fluidizing device with specific improvements over the prior art for controlling and measuring powder feed uniformity and rates including sieve plates used to control and meter powder from the hopper to the vibrating bowl.

FIG. 1 show the basic embodiment of the powder-fluidizing device 1 used in this invention. The hopper 2 is isolation mounted to plate 3 which is mounted through a first structural support bracket 4 that is detachable from a second structural support bracket 5 which mounts to the pressure housing base 6 via the mass sensor 7. Detachment of first structural support bracket 4 from the second structural support bracket 5 permits the hopper 2 to be removed from the vibrating bowl 8 for cleaning and servicing of components. A upper sieve plate 9 mounted within hopper 2 meters powder 10 onto a lower sieve plate 11 for more precise metering of powder 10 into funnel tube 12. Funnel tube 12 at the base of the hopper 2 extends down into the vibrating bowl 8 to direct the powder 10 agitated through the sieve plates 9 and 10 into the vibrating bowl 8. The funnel tube 12 restricts the powder 10 fuming to a small confined volume within the powder-fluidizing device 1 as the powder 10 drops to the vibrating bowl 8 surface. This technique also eliminates any coupling between the vibrating bowl 8 and the funnel tube 12 that may dampen or perturb the vibration intensity during operation.

The invention includes another improvement over the prior art of U.S. Pat. No. 3,618,828 to dissipate agglomeration and clumping of the powder 10 by heating the hopper 2 and stored powder 10 to a temperature in the range of 100–250° F. using a band heater 13 attached to the structural base 14 of the hopper 2. This technique permits any moisture or other volatile contamination to be driven from the powder 10 and removed with the carrier gas 15. In addition, the electrostatic agglomeration forces are dissipated at elevated temperatures, which tend to improve the powder flow characteristics.

This invention includes several techniques for level sensing of powder 10 in the reservoir of the vibrating bowl 8. One method uses a flexible metal vane 16 (type of float) that deflects in proportion to the level of powder 10 in the vibrating bowl 8 as said powder 10 is rotated in a spiraling manner to toward the discharge outlet 17. A conventional proximity switch 18 based on eddy current, magnetic, capacitance, or optical measurement detects deflection of the flexible metal vane 16 to switch the AC power to the hopper vibrator 19 or to proportionally control the vibration intensity. The exit of the funnel tube 12 is designed with a cutout notch 20 to preferentially accumulate powder 10 in front of the flexible metal vane 16 so as to insure deflection thereof. Other sensing techniques including optical interrupter switches, optical ranging devices, eddy current, magnetic, an capacitance transducers are included as alternative embodiments of a powder level sensor.

Figure 2:
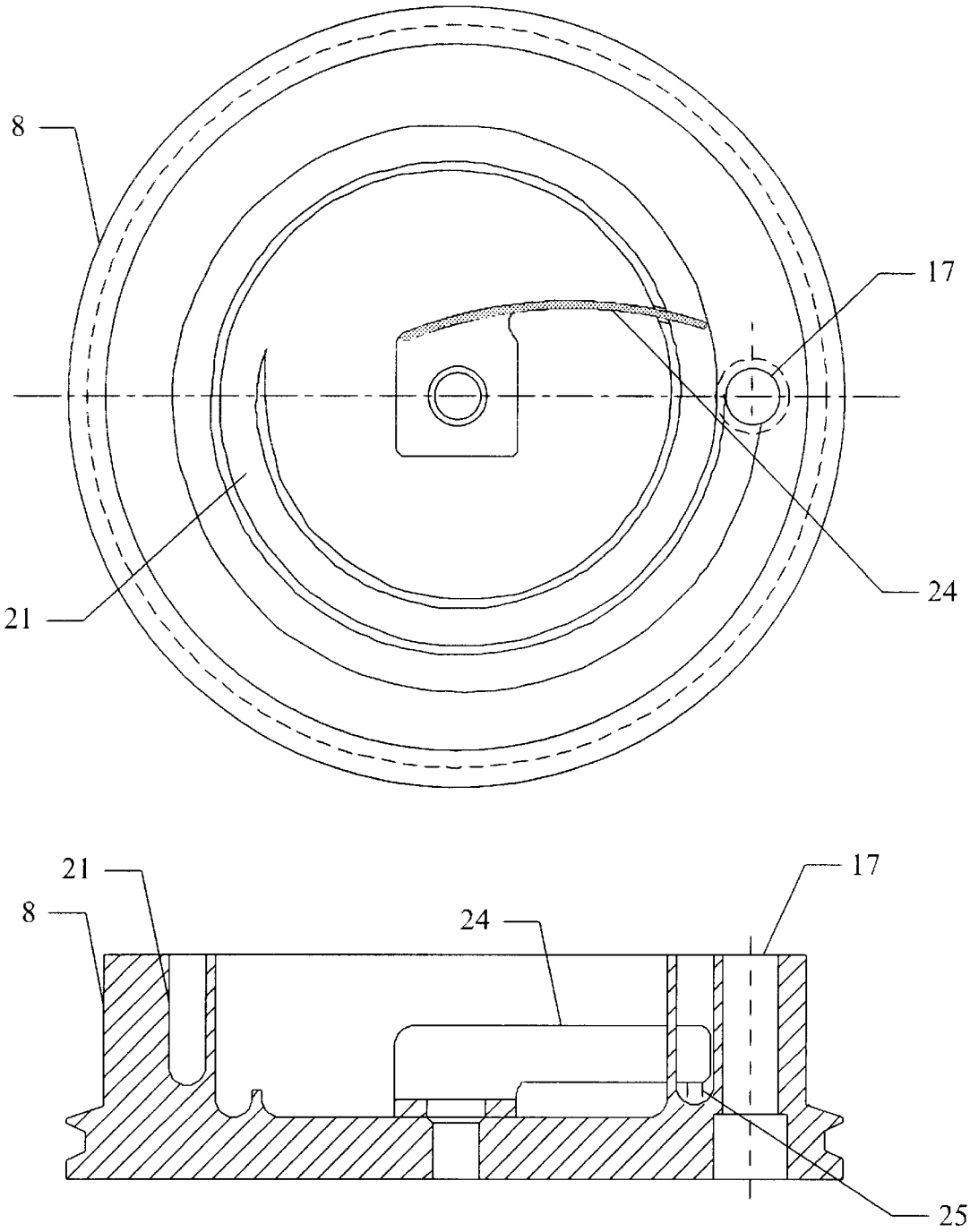
FIG. 2. Cross-section and top plan view of the vibrating bowl with a spiral-ramp groove running from the central reservoir region to the discharge outlet for the bowl. Figure also depicts a gate valve installed in the vibrating bowl to fine-tune the metering of powder through the gate valve aperture defined by the height above the base of the spiral-ramp groove and the width of the groove.

Referring now to FIGS. 1 and 2, the vibrating bowl 8 of this invention is further improved with a spiral-ramp groove 21 that spirals up a ramp from the bottom of the vibrating bowl 8 to the discharge tube 17. The width and cross-section shape of the spiral-ramp groove 21 is designed to translate and meter the powder 10 up the spiral-ramp groove 21 at a flow rate in proportion to the applied rotary vibration intensity. The vibrator mechanism 22 uses conventional electromagnetic poles to rotationally drive and oscillate a bowl mounting plate 23 such as the technique disclosed in U.S. Pat. No. 3,618,828 or other commercial parts feeding and conveying vibrators such as those manufactured by FMC Corp., Homer City, Pa. The angle of the spiral-ramp groove 21, relative to the horizontal plane, is adjusted to provide a minimum of one revolution in which to raise the powder 10 above a reservoir level as determined by the flexible metal vane 16 or other level sensing device. Typically the cross-section shape of the spiral-ramp groove 21 is hemispherical at the base of channel, but other shapes including chamber radii rectangular or square channels are included. The depth of the spiral-ramp groove 21 is yet another variable for controlling the metering of the powder 10 from the reservoir to the discharge outlet 17 of the vibrating bowl 8. A gate valve 24 (dam or scraper) can also be inserted into the spiral-ramp groove 21 at various depths and locations to fine-tune the metering of the powder 10 through the gate-valve 24 apertures as the powder 10 is rotationally translated up the spiral-ramp groove 21. It is also advantageous to permit the gate valve 24 to vibrate in order to prevent agglomeration and clumping of the powder as it translates through the aperture. Rake fingers 25, for example a single wire or plurality of wires, mounted in the center of the spiral-ramp groove 21 can also be used to break up agglomerating and clumping powder 10 to provide a more uniform powder flow rate.

The discharge outlet 17 from the vibrating bowl 8 has an additional improvement over the prior art of U.S. Pat. No. 3,618,828, wherein the discharge outlet 17 extends down through the vibrator mechanism 22 via a flexible polymeric tube 26 to mitigate vibration coupling between the vibrating bowl mounting plate 23 and the base 27 of the vibrator mechanism. The distal end of said discharge tube 17 partially protrudes into an outlet funnel 28 for connecting the powder-fluidizing device 1 to an application gun or nozzle via a high-pressure flexible hose or tube. This feature permits the carrier gas 15 to flow independent of the powder 10 dispensing over a wide range of gas flow rates and pressures, while entraining and mixing the powder 10 into the carrier gas 15 as the mixture is discharged from the powder fluidizing device 1. The outlet funnel 28 internal diameter and taper is matched to the internal diameter of the flexible hose or tube to maintain the powder 10 flow in the carrier gas 15 at velocities sufficiently high to prevent settling and agglomeration of the powder within the hose.

Finally an additional improvement of this invention over the prior art is the addition of a mass sensor 7 (e.g., electronic load cell or optical load cell) mounted between the pressure housing base 6 and the second structural support bracket 5 that permits a measurement of the mass of powder 10 remaining in the hopper 2. The signal from the mass sensor 7 also permits the powder flow rate to be computed as the average mass loss rate of powder flowing from the powder-fluidizing device 1. Both of these measurements are independent of the gas mass flow rate, which permits the powder flow rates to be measured and controlled to a set point via a Proportional Integral Derivative (PID) feedback controller to the power supply for the bowl vibrator. These PID controllers can be implemented with conventional analog electronic devices or with software algorithms such as those supplied by National Instruments in LabView™ virtual instrumentation software.

The carrier gas 15 pressurizes the powder-fluidizing device 1 cavity enclosed by the pressure housing 29 and the pressure-housing base 6 via a pipe coupling clamp 30 sealed by a rubber seal 31. The cap 32 installed in pressure housing 29 provides the means for venting pressurized carrier gas 15 through vent valve 33 and for refilling the hopper 2 using a conventional funnel inserted into port 34.

It should be pointed out that a plurality of powder fluidizing devices 1 disclosed in this invention could be used to mix and entrain various powders at selected concentrations into a common manifold that is connected to the gun of a nozzle applicator.

Figure 3:
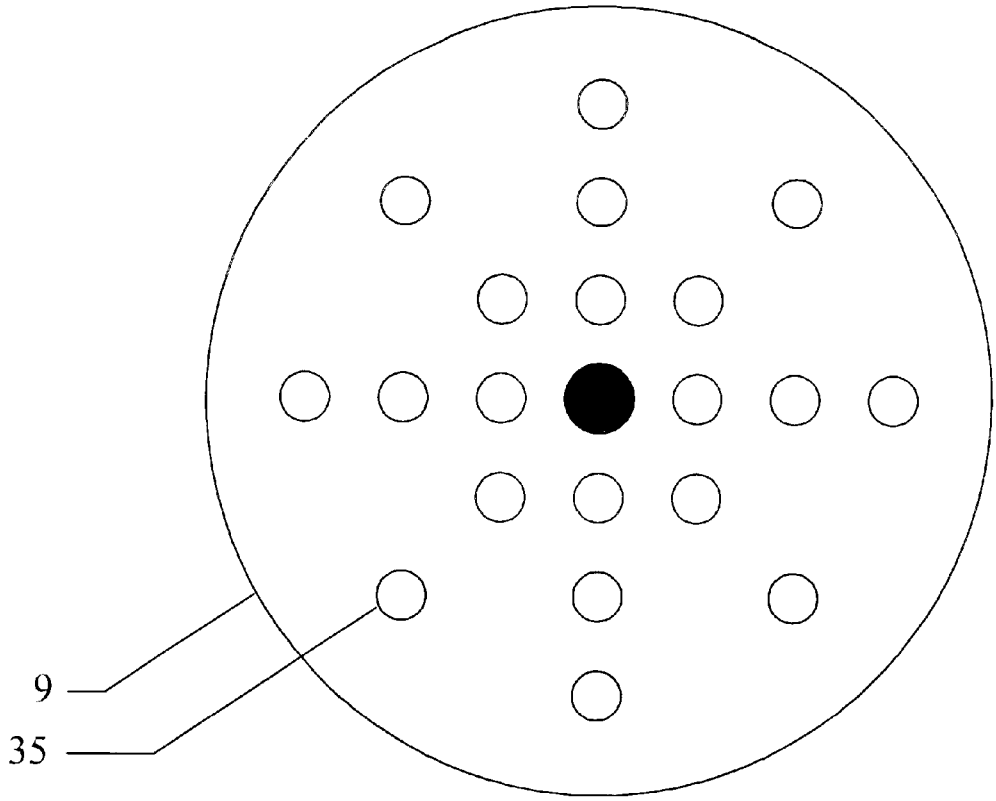
FIG. 3. Shows a plan view of typical upper and lower sieve plates used to control and meter powder from the hopper to the vibrating bowl.
Figure 3:
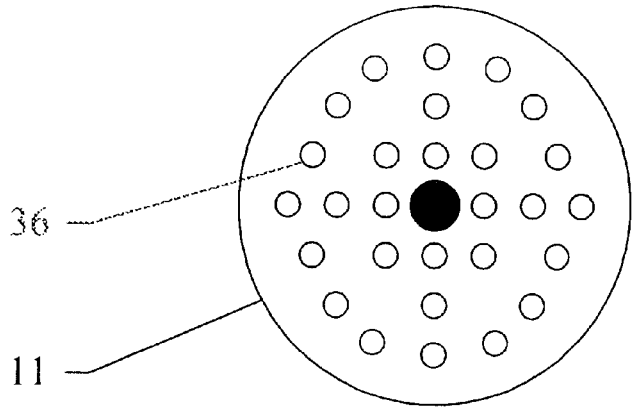

A particular combination of upper sieve plate 9 and lower sieve plate 11 is shown in FIG. 3 with a plurality of holes 35 and 36 tuned to dispense powder under conditions suitable for flow characteristics of the powder 10 and to meet the flow rate demand for the specific application. The number and distribution of holes in the upper sieve plate 9 and lower sieve plate 11, and the hole-size, permit tuning of the sieve plates (9 and 11) for a particular powder 10. Variable hole size in the upper sieve plate 9 and lower sieve plate 11 can also be accomplished by coupling a dual plate together with a similar hole pattern and rotating one plate in reference to the other in order to occult the hole area in a variable manner. Referring again to FIG. 1, a mechanical or electrical driven vibrator 19 attached to plate 3 is used to shake the powder down through the sieve plates (9 and 11) on demand from a flexible metal vane switch 16. The hopper 2 is vibration isolated from the vibrating bowl 8 through the first structural support bracket 4 and the second structural support bracket 5 of the powder-fluidizing device 1 with shock absorbing mounts. A signal from the flexible metal vane switch 16 is used to control (PID feedback or on/off switching) the hopper vibrator 19 so as to meter powder 10 at an acceptable rate.

Figure 4:
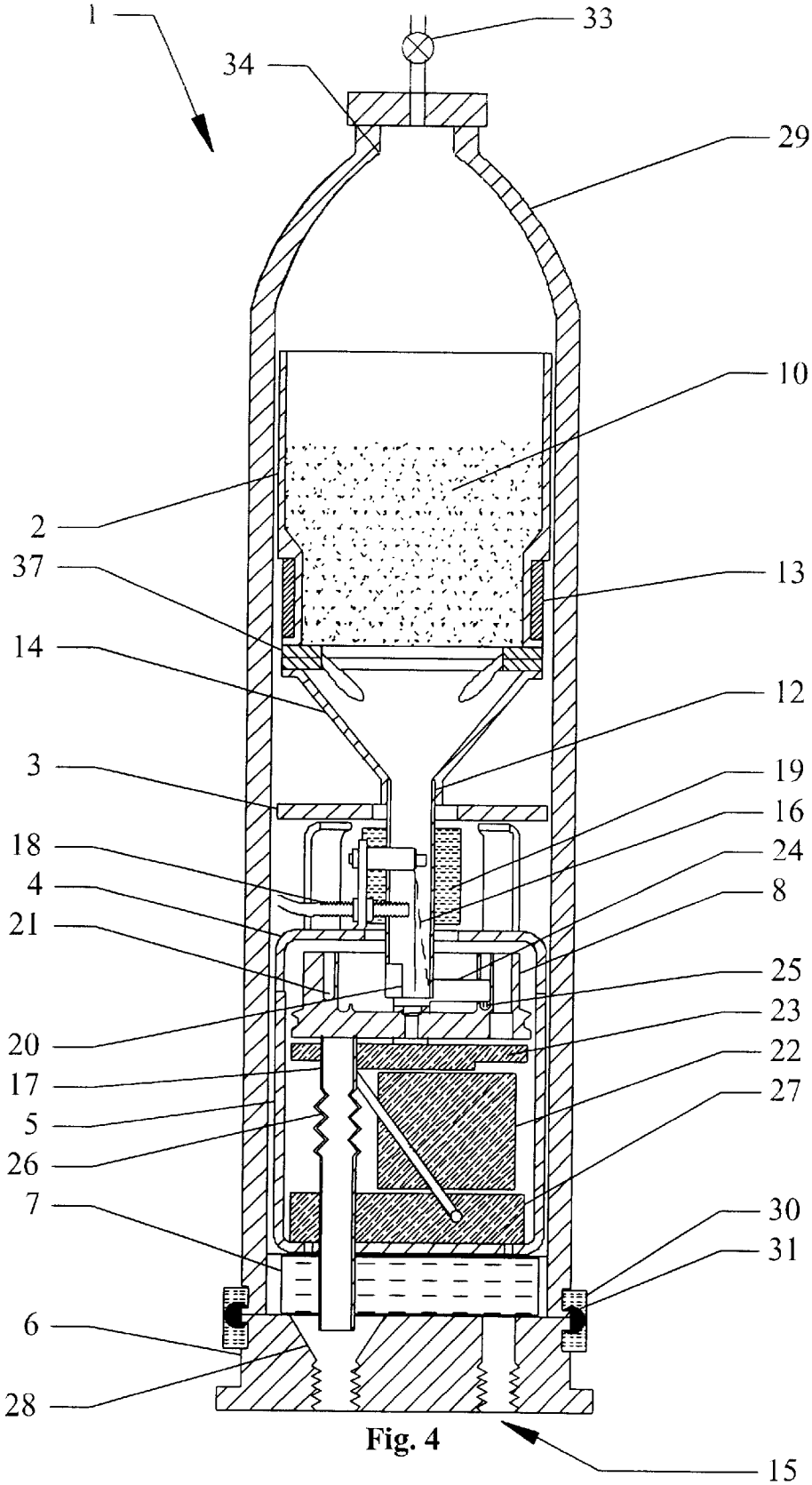
FIG. 4. Cross-section view of the powder-fluidizing device with specific improvements over the prior art for controlling and measuring powder feed uniformity and rates including a an iris valve used to control and meter powder from the hopper to the vibrating bowl.
Figure 5:
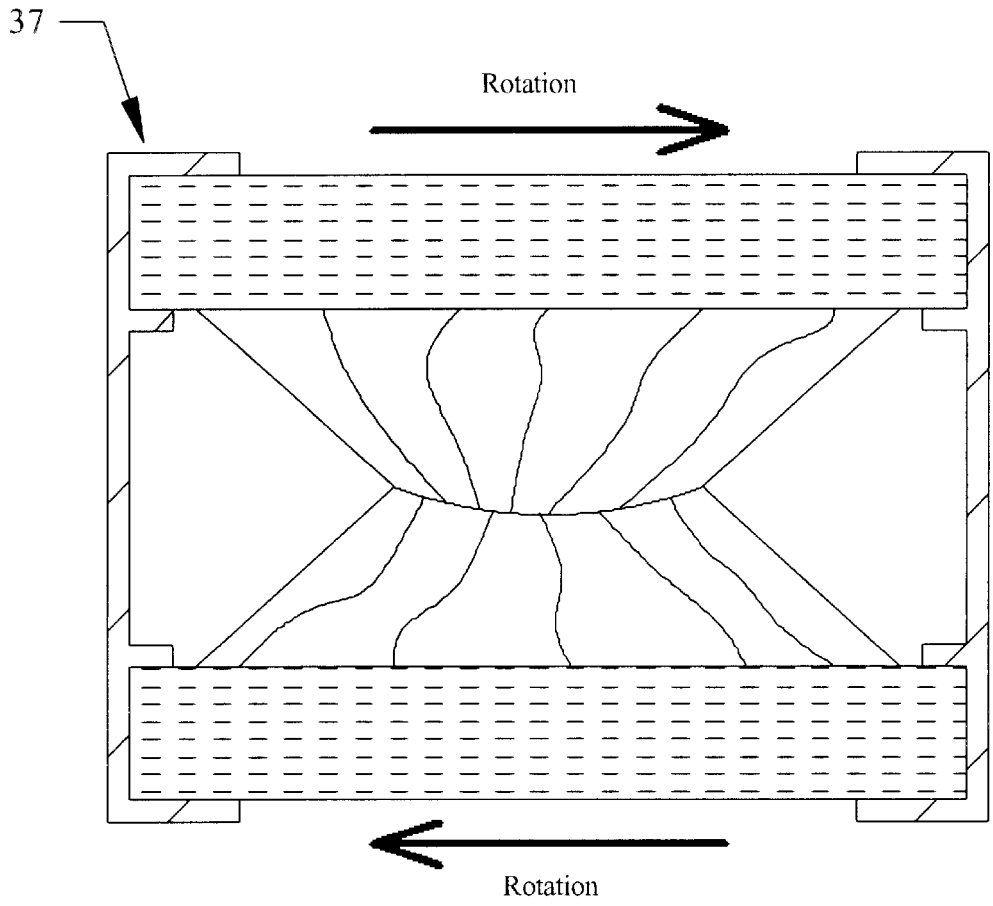
FIG. 5. Cross-section view of an iris valve used as an alternative embodiment to control and meter powder from the hopper to the vibrating bowl.

Alternatively, the metering of powder 10 into the vibrating bowl 8 can be accomplished by using a variable orifice iris valve 37 at the outlet of the hopper 2 as shown in FIG. 4. A rotary actuator as shown in FIG. 5 can remotely control iris valves 37 such as those sold by FMC INC. or Mucon, Inc. A linear motor, lead screw assembly, solenoid, pneumatic cylinder, or hydraulic cylinder can be used to drive the rotary actuator for controlling the variable orifice area of the valves. Other types of pinch valves such as the AirFlex® device manufactured by RF Technologies, Inc. or the flex tube device disclosed in U.S. Pat. No. 6,056,260 issued to Stewart and Day can also be used. Conventional cone valves used in hopper for bulk feeding of powders could also be used to meter powder from the hopper to the vibrating bowl. Again, a signal from the flexible metal vane 16 switch or other bowl level sensor is used to control (PID feedback or on/off switching) the hopper vibrator 19 so as to meter powder 10 at an acceptable rate.

Figure 6:
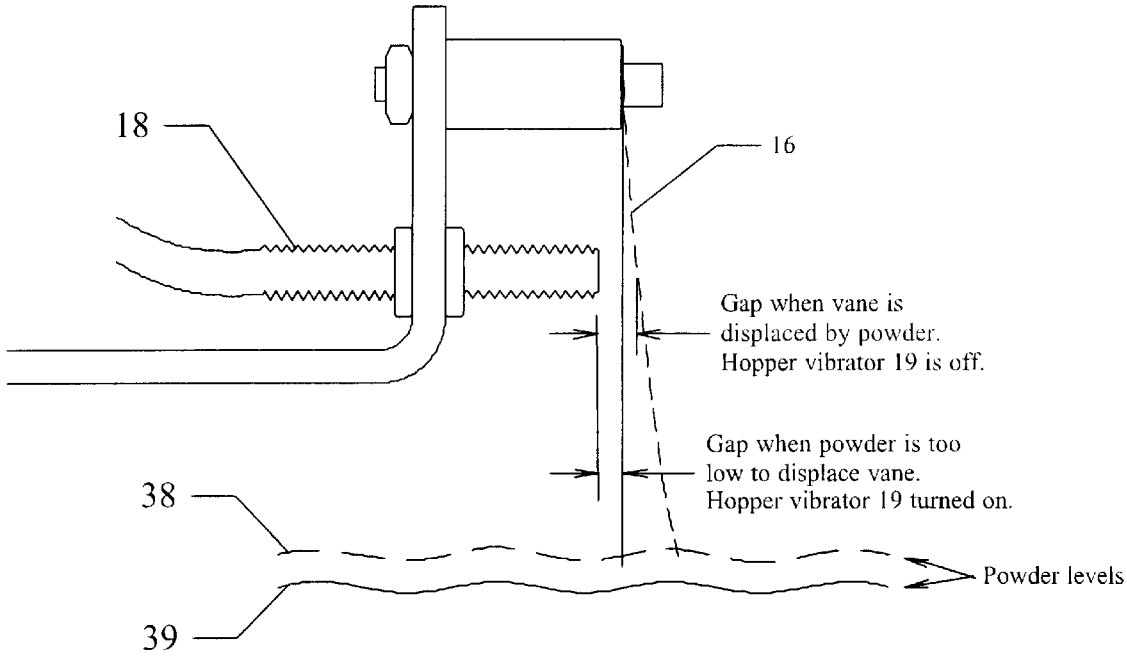
FIG. 6. Shows a plan view of a vibrating bowl powder level sensor using a flexible metal vane in combination with a proximity switch.

A detailed drawing of the powder level, sensor in the vibration bowl 8 is shown in FIG. 6. This particular embodiment uses an Eddy current proximity switch 18 that detects the displacement of the flexible metal vane 16 as the powder 10 level decreases from level 38 to level 39. Referring to FIGS. 1 and 6, the hopper vibrator 19 is turn on by the proximity switch 18 when the powder 10 is at level 39 which begins to meter powder from the hopper 2 through the upper sieve plate 9 and lower sieve plate 11 down through the funnel tube 12 until the powder level 38 in FIG. 6 is reached. Once the powder level 38 is attained the proximity switch 18 turns the hopper vibrator 19 off and the cycle is repeated to keep the powder 10 in the vibrating bowl 8 at nearly a constant level. Other types of sensors including optical interrupter switches, optical ranging devices, magnetic, or capacitance transducers could be used to detect the displacement of the flexible metal vane 16 or detect the powder levels 38 and 39 in the vibrating bowl. In many cases, these sensors could provide a continuous signal proportional to the difference between level 38 and level 39 which would operate the hopper vibrator 19 intensity in proportion to the powder 10 level through PID feedback. This approach could be used to improve the precision of the powder 10 metering from the hopper 2 to the vibrating bowl 8 by providing a more constant level of powder 10 between level 38 and 39.

Figure 7:
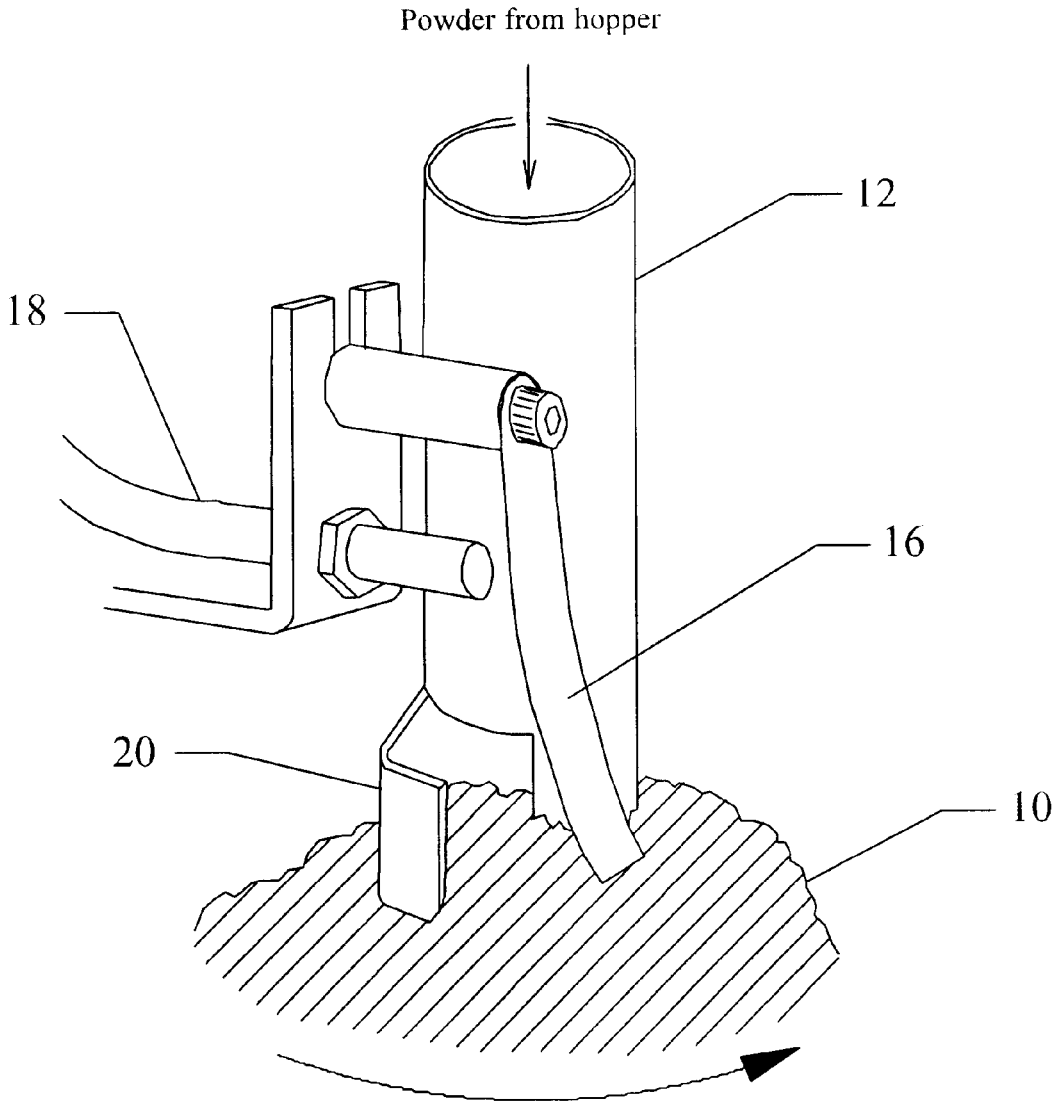
FIG. 7. Shows an isometric view of the vibrating bowl powder level sensor with flexible metal vane in relationship to exit of the hopper funnel tube that ensures accumulation of powder in front of the flexible metal vane so as to induce deflection thereof.

FIG. 7 shows a detail drawing of the cutout notch 20 in the funnel tube 12 that is used to accumulated powder 10 in front of the flexible metal vane 16 switch. Rotational vibrating of the vibrating bowl 8 shown in FIGS. 1 and 2 induces rotation of the powder 10 in a counterclockwise direction as depicted in FIG. 7.

Figure 8:
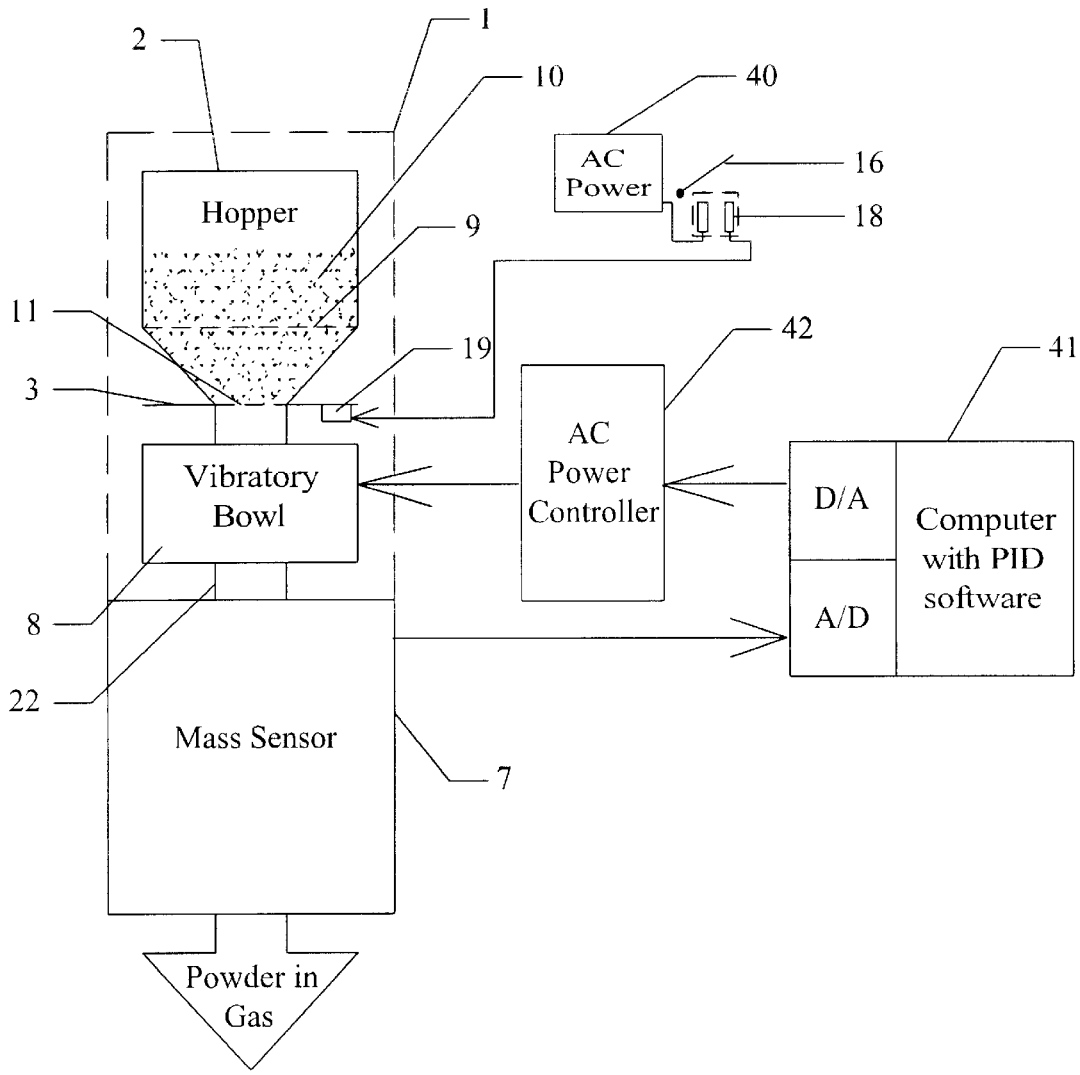
FIG. 8. Shows a block diagram of a mass sensor used to measure mass loss rates and a PID controller to adjust the AC power to the electromagnets of the vibrating bowl in proportion to a preset feed rate. Figure also shows the use of flexible metal vane proximity switch to control the AC power to the hopper vibrator for agitating the powder down through the upper and lower sieve plates.

FIG. 8 is schematic of the control system used to drive the powder-fluidizing device 1. The AC electrical power 40 to the hopper vibrator 19 is switched on and off by the proximity switch 18 associated with the flexible metal vane 16 used to control the level of powder 10 in the vibrating bowl 8. The powder 10 is agitated down through upper sieve plate 9 and lower sieve plate 11 whenever AC electrical power 40 is applied to the hopper vibrator 19. FIG. 8 also shows a computer controlled PID feedback system 41 for controlling the AC power controller 42, which determines the current delivered to the electromagnets in the vibration mechanism 22 of the vibrating bowl 8. The powder feed rate derived from the mass sensor 7 is regulated to a desired set point by the PID feedback system 41. Note other transducers including coriolis mass flow, turbidity, and thermal loss could be used to measure the powder feed rate in this embodiment.

Although many different particle-spraying processes can be used with the powder fluidizing apparatus and process disclosed in this invention, one specific example is illustrated to demonstrate the capabilities. The powder-fluidizing device disclosed in this invention is notably designed to feed ultra-fine or nanoscale powders into choked nozzles that operate at inlet gas pressures well in excess of atmospheric pressure. The friction compensated sonic nozzles disclosed in the aforementioned U.S. patent application Ser. No. 10/116,812 filed by Tapphorn and Gabel on Apr. 5, 2002 represent a particular type of nozzle that can be used with the powder-fluidizing device. In tests conducted with the powder fluidizing apparatus, aluminum powder having an average particle size of 20 micrometers with an upper limit of 45, micrometers was blended 50% by weight with chromium powder (<45 micrometers) and fed into the friction compensated sonic nozzles as per the specifications disclosed in the aforementioned U.S. patent application Ser. No. 10/116,812 filed by Tapphorn and Gabel on Apr. 5, 2002. The powder flow rate for these tests indicated a mass flow rate within ±1% of the set point (30 gm/min) with a ±1% precision over sampling periods of 90 seconds as determined by a mass loss measurements using the internal mass sensor 7. Other choked nozzles, including supersonic nozzles as disclosed in U.S. Pat. No. 5,795,626 issued to Gabel and Tapphorn and U.S. Pat. No. 6,074,135 issued to Tapphorn and Gabel can also be used with the powder-fluidizing device for uniformly spraying ultra-fine or nanoscale powders independent of the carrier gas flow rates.

Figure 9:
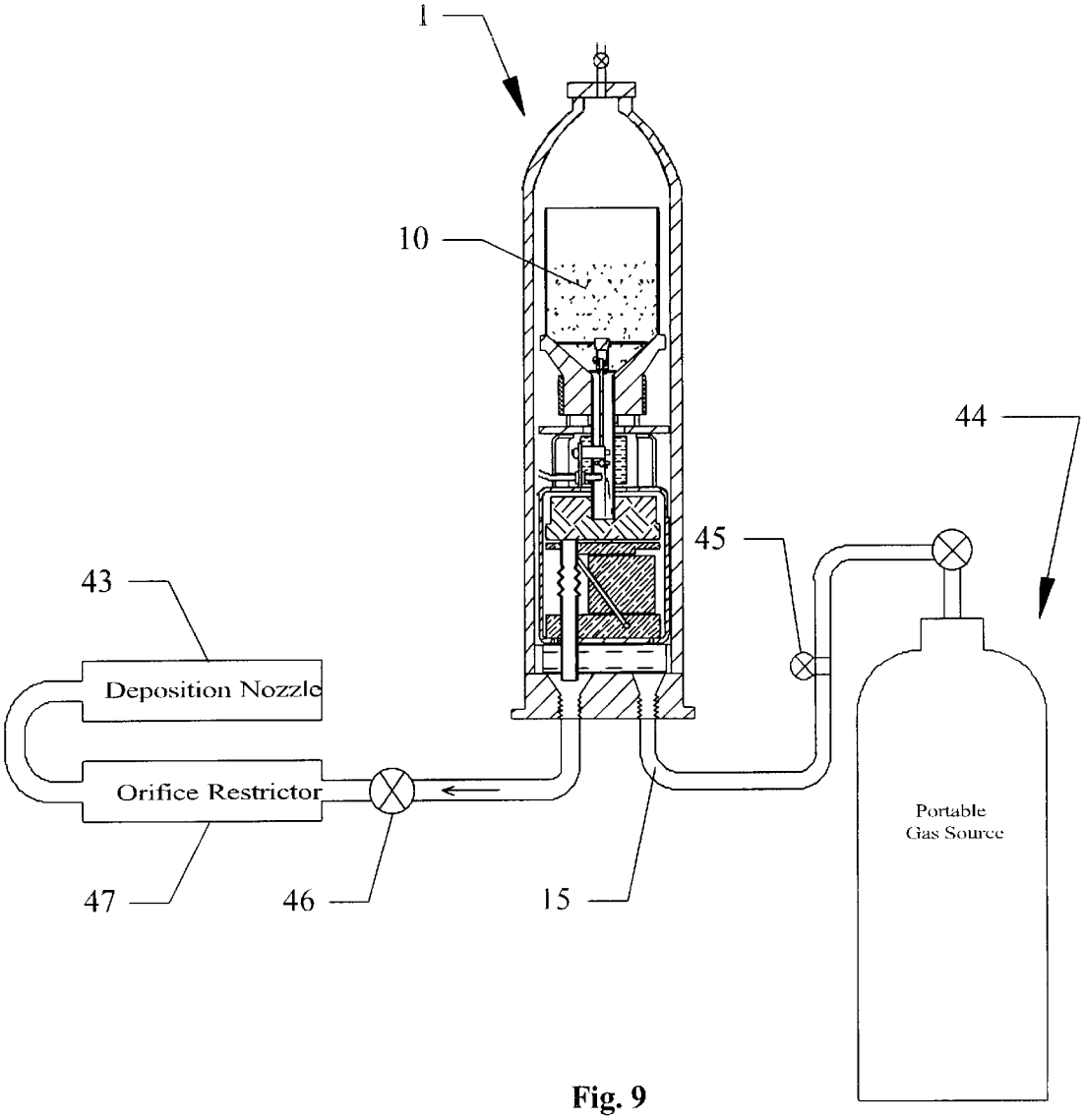
FIG. 9. Block diagram of first embodiment for a portable powder deposition apparatus using the powder-fluidizing device shown in cross-section. Figure also shows the use of an orifice restrictor in combination with a friction compensated sonic nozzle for modifying and controlling feed rates to the nozzle.

A first embodiment of a portable powder deposition apparatus that uses the powder-fluidizing device 1 is shown schematically in FIG. 9. The first embodiment of the portable powder deposition apparatus consists of using a nozzle 43 such as a friction compensated sonic nozzle disclosed in the aforementioned U.S. patent application Ser. No. 10/116,812 filed by Tapphorn and Gabel on Apr. 5, 2002 in combination with the powder-fluidizing device 1 of this invention. A portable gas source 44 consisting of helium, nitrogen, argon or mixture thereof stored in small portable cylinders is used with the portable-powder deposition apparatus. For this particular embodiment, carrier gas 15 is injected into powder-fluidizing device 1 to entrain powder 10 particles prior to injection into the nozzle 43. Adjusting a conventional regulator 45 sets the operating pressure, and the carrier gas 15 with entrained powder 10 is injected into the handheld nozzle via flow control valve 46. Optionally, an orifice-restrictor 47 such as a second friction compensated sonic nozzle disclosed in the aforementioned U.S. patent application Ser. No. 10/116,812 filed by Tapphorn and Gabel on Apr. 5, 2002 connected in series with the nozzle 43 is used to additionally modify and control the flow rate of the powder 10 particles entrained in the carrier gas 15. The orifice diameter is sized to yield the desired result, but typically is comparable to the throat dimensions of the nozzle 43. This first embodiment of the portable powder deposition apparatus is typically used for depositing metallic spot coatings, touchup coatings, or in-situ repairs of components or structures by spray forming. Conventional sand blasting cabinet or other enclosure evacuated through a conventional dust collector filter (not shown explicitly in FIG. 9) can be used to environmentally contain the excess powder released during spray operations and to vent the inert gases to the atmosphere.

Figure 10:
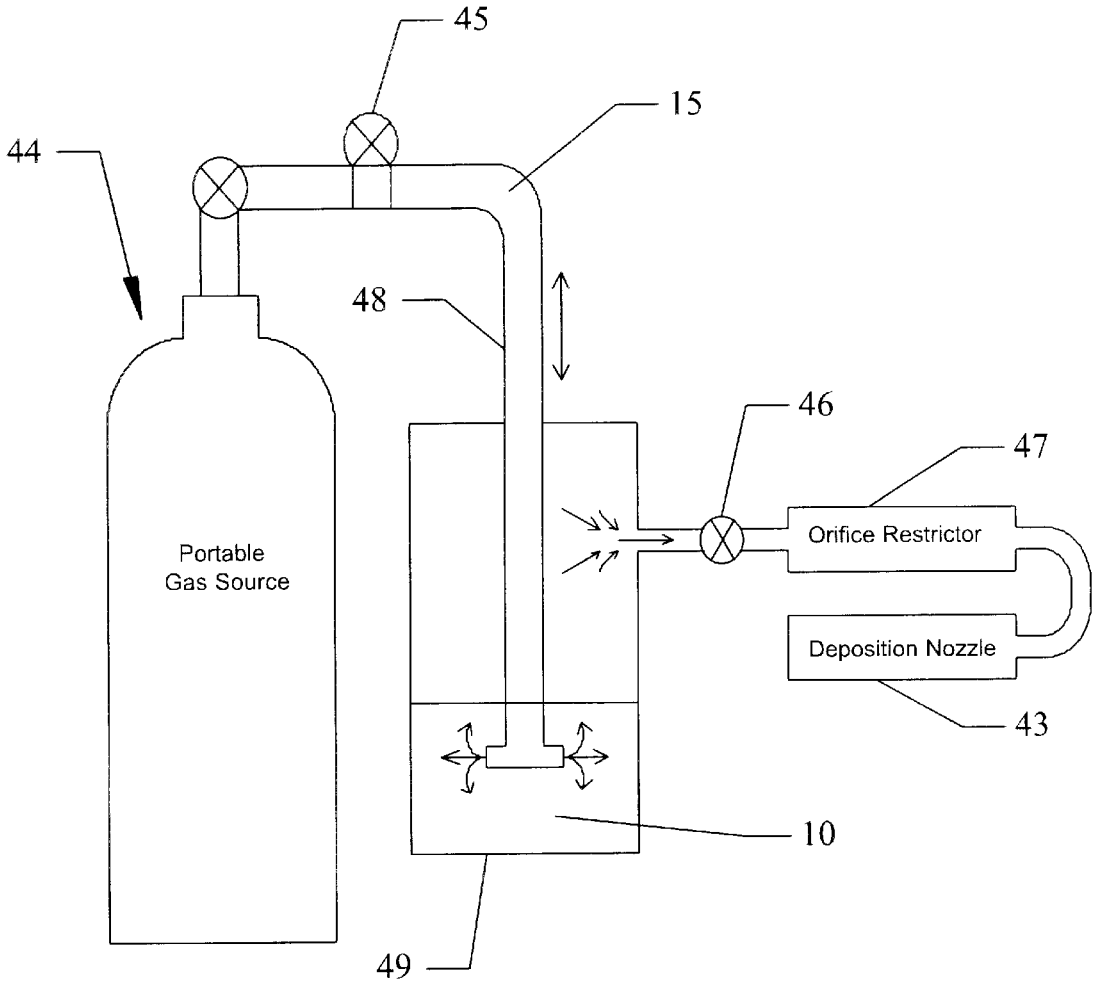
FIG. 10. Block diagram of second embodiment for a portable powder deposition apparatus using a technique for fluidizing powders above the level of the bulk powder. Figure also shows the use of an orifice restrictor in combination with a friction compensated sonic nozzle for modifying and controlling feed rates to the nozzle.

A second embodiment of the portable powder deposition apparatus shown in FIG. 10 includes using a nozzle 43 such as a friction compensated sonic nozzle disclosed in the aforementioned U.S. patent application Ser. No. 10/116,812 filed by Tapphorn and Gabel on Apr. 5, 2002 in combination with an alternative embodiment of a powder-fluidizing chamber 49 that uses a movable fluidizing port 48 mounted within the powder-fluidizing chamber 49 for dispensing small quantities of powder 10 to the nozzle 43 for touching up coated areas or spray forming repairs. This alternative embodiment of the powder-fluidizing chamber 49 was also disclosed in the aforementioned U.S. patent application Ser. No. 10/116,812 filed by Tapphorn and Gabel on Apr. 5, 2002 as a method of fluidizing powders above the level of the powder. A portable gas source 44 consisting of helium, nitrogen, argon or mixture thereof stored in small portable cylinders is used with this second embodiment of the portable powder deposition apparatus. Optionally, an orifice-restrictor 47 such as a second friction compensated sonic nozzle disclosed in the aforementioned U.S. patent application Ser. No. 10/116,812 filed by Tapphorn and Gabel on Apr. 5, 2002 connected in series with the hand held nozzle 43 is used to additionally modify and control the flow rate of the powder particles entrained in the carrier gas 15. This second embodiment of the portable powder deposition apparatus is also typically used for depositing metallic spot coatings, touchup coatings, or in-situ repairs of components or structures by spray forming. A conventional sand blasting cabinet or other enclosure evacuated through a conventional dust collector filter (not shown explicitly in FIG. 10) can be used to environmentally contain the excess powder released during spray operations and to vent the inert gases to the atmosphere.

Figure 11:
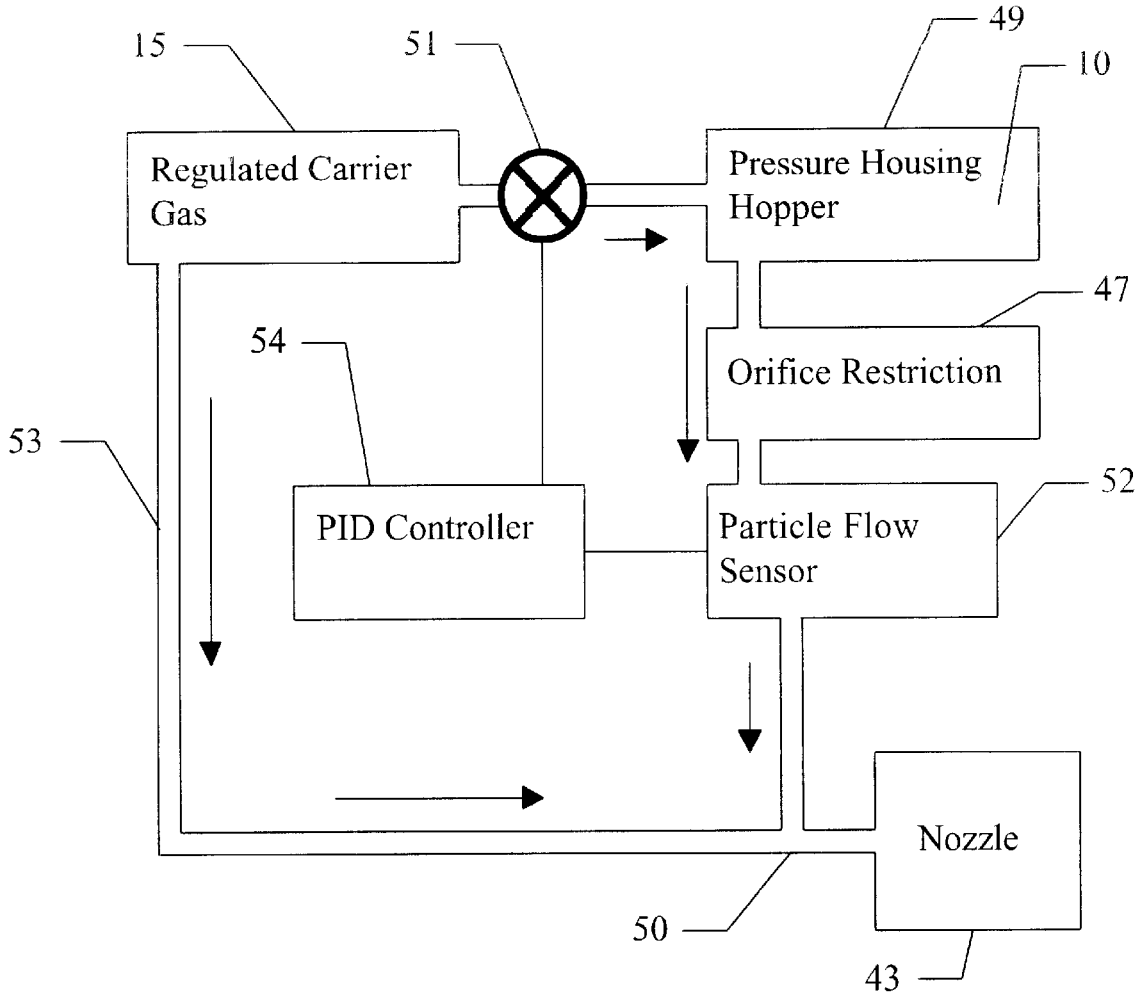
FIG. 11. Block diagram of a third embodiment for a portable powder deposition apparatus using a powder fluidizing device for microgravity operations in which the particle flow sensor is used to control the feeding of powder via adjustment of carrier gas flow through the powder fluidizing device relative to process line carrier gas flow. Figure also shows the use of an orifice restrictor in combination with a friction compensated sonic nozzle for modifying and controlling feed rates to the nozzle.

Referring to schematic diagram of FIG. 11, a third embodiment of the portable powder deposition apparatus for use in microgravity consists of using a nozzle 43 such as friction compensated sonic nozzle disclosed in the aforementioned U.S. patent application Ser. No. 10/116,812 filed by Tapphorn and Gabel on Apr. 5, 2002 in combination with the powder-fluidizing chamber 49 describe in FIG. 10. In microgravity, the entire powder 10 load in the powder-fluidizing chamber 49 will be dispersed within the carrier gas 15 rather than resting on the bottom of the powder-fluidizing chamber 49. Electrostatic forces will still be present which can lead to local agglomerations, but these forces can be successfully dissipated in most powders by heating the powder to a temperature of 340 K. An orifice restrictor 47 in the outlet line of the powder fluidizing chamber 49 is used to control the volumetric admixture of the carrier gas 15 with entrained powder particles injected into a manifold 50 located at the inlet to the nozzle 43 comprising the friction compensated sonic nozzle. A remotely controlled metering valve 51 adjusts the carrier gas 15 flow rate through the powder-fluidizing chamber 49 in proportion to a required or preset powder flow rate. This technique requires a particle flow sensor 52 for measuring the particle flow rates of the powder independent of carrier gas 15 flow rates. A conventional turbidity sensor is the most reliable technique for measuring powder particle flow rates in microgravity environments, with negligible sensitivity to the carrier gas 15 flow rate. Turbidity sensors can be constructed using light emitting diodes and photodiodes mounted with diamond-coated windows within a flow sensor housing to measure light attenuation as the powder occults the beam path. A PID controller 54 is used to adjust the carrier gas 15 flow rate for a preset particle flow rate as calibrated in accordance with the turbidity sensor signal. Powder entrain in the carrier gas 15 is then mixed with additional carrier gas 53 at the manifold 50 prior to injection into the nozzle 43.

Figure 12:
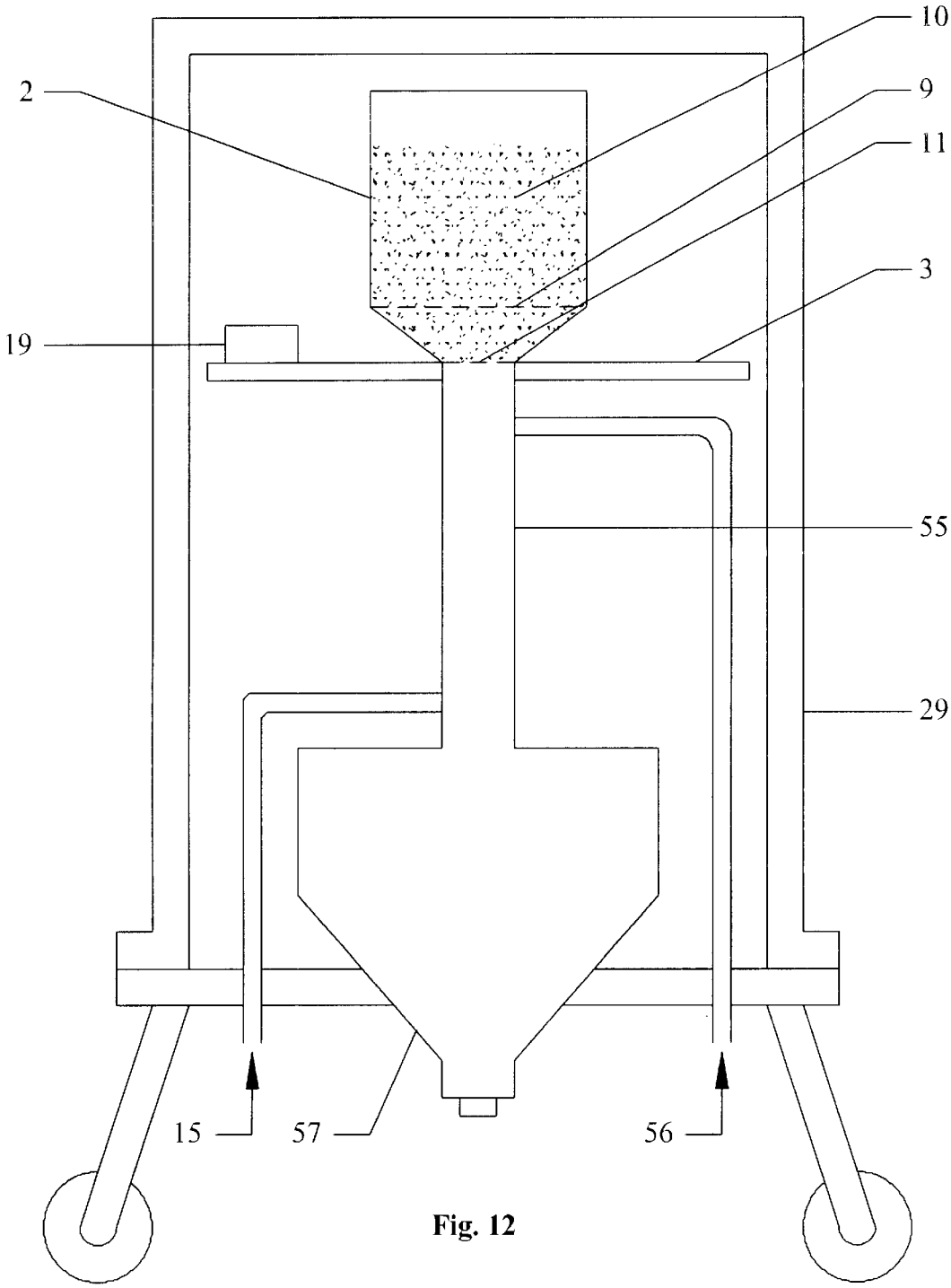
FIG. 12. Schematic diagram of a powder fluidizing device for fluidizing powders within a drop tube in which carrier gas is used to entrain powder during gravity flow of the powder through an upper and lower sieve plate or pinch valve that is metered by a vibrator attached to the hopper.

A schematic diagram of another embodiment for a powder-fluidizing device that uses a drop tube 55 is shown in FIG. 12. Powder 10 is entrained in the carrier gas 15 during gravity flow of the powder 10 that is metered through the upper sieve plate 9 and lower sieve plate 11 by a hopper vibrator 19 attached to plate 3 of the hopper 2. The drop tube 55 of the powder-fluidizing device is used to create a powder-dispersed condition, while simultaneously entraining the powder 10 in the carrier gas 15 at a specific concentration prior to exiting the pressure housing 29 through outlet 56. To achieve heavy concentrations of powder 10 dispersed in the drop tube 55, it is necessary to introduce a conventional pinch or iris valve in the outlet of the hopper, which can be remotely activated. The powder recovery chamber 57 at the base of the drop tube 55 is used to collect excess powder 10 that is not entrained into the carrier gas 15.

The types of powder particles that can be deposited or consolidated using the apparatus and process of this invention are selected from a group but are not limited to powders consisting of metals, alloys, low temperature alloys, high temperature alloys, superalloys, braze fillers, metal matrix composites, nonmetals, ceramics, polymers, and mixtures thereof. Indium or tin-based solders and silicon based aluminum alloys (e.g., 4043, 4045, or 4047) are examples of low temperature alloys that can be deposited and consolidated in the solid-state for coatings, spray forming, and joining of various materials using the apparatus and process of this invention. High temperature alloys include, but are not limited to NF616 (9Cr-2W—Mo—V—Nb—N), SAVE25 (23Cr-18Ni—Nb—Cu—N), Thermie (25Cr-20Co-2Ti-2Nb—V—Al), and NF12 (11Cr-2.6W-2.5Co—V—Nb—N). Superalloys include nickel, iron-nickel, and cobalt-based alloys disclosed on page 16-5 of Metals Handbook, Desk Edition 1985, (American Society for Metals, Metals Park, Ohio 44073. Powder particles coated with another metal such as nickel and cobalt coated tungsten powders are also included as a special type of composite powder that can be used with apparatus and process of the invention.

The preferred powder particle size for the apparatus and process of this invention is generally a broad distribution with an upper limit of −325 mesh (<45 micrometers), but powder particles sizes in excess of 325 mesh (45 micrometers) are frequently selected as strengthening agents for co-deposition with a matrix material for forming metal matrix composites. Powder particle sizes in the nanoscale regime can also be deposited and consolidated with apparatus and process of this invention.

The types of substrate materials that can be coated or used for deposition and consolidation surfaces with the apparatus and process of the invention are selected from a group but are not limited to materials consisting of metals, alloys, low temperature alloys, high temperature alloys, superalloys, metal matrix composites, nonmetals, ceramics, polymers, and mixtures thereof.

Various gases can be used with the present invention and are selected from a group comprising air, argon, carbon tetrafluoride, carbonyl fluoride, helium, hydrogen, methane, nitrogen, oxygen, silane, steam, sulfur hexaflouride, or mixtures thereof.

Methods for depositing nonmetallic powders selected from a group comprising polymers, ceramics, or glasses using the apparatus and process of this invention are also disclosed. In particular powders of high-density polyethylene or polytetrafluoroeythylene (Teflon™) can be applied as thin coatings. Although not intended to accommodate the high temperature depositions required for melting ceramic and glass powders, these materials can be co-deposited as an ex-situ strengthening agent (powder form) in metallic or nonmetallic matrix materials.

The technical advantage of using the process described in this invention over existing spray coating technologies (e.g., gas thermal spray, plasma arc-spray, wire-arc-spray, and high velocity oxygen-fuel spray) is that it produces low-porosity metal depositions with no surface pretreatment, excellent adhesion, no significant in-situ oxidation, and no coating-process induced thermal distortion of the substrate.

Finally, the apparatus and process of this invention permits co-deposition of powders to functionally form in-situ and ex-situ composites. In one example, a metallic powder (e.g., aluminum) is co-deposited with an ex-situ strengthening agent selected from a group comprising silicon, carbide, boron carbide, alumina, tungsten carbide, or mixtures thereof to form a particle reinforced metal matrix composite that has homogeneous dispersion of the strengthening agent. In another example the invention permits the co-deposition of metallic powders into a consolidated composite that is subsequently transformed (final heat treatment) into an in-situ particle reinforced metal matrix composite after finish machining. A variation of this example permits the co-deposition of metallic powders with other metallic or nonmetallic powder mixtures to tailor coatings or spray formed materials with unique properties. For instance, by co-depositing mixtures of aluminum and chromium powders (equal parts by weight), an electrically conductive strip can be applied to steel that has a tailored electrical resistivity (i.e., typically 72 $\mu\Omega$-cm), excellent corrosion resistance (20 years in salt water immersion at 70° F.) and an excellent adhesion strength on steel.

The invention also includes consolidation of functionally graded materials in which the properties of the deposition (e.g. thermal expansion) are functionally graded in discrete or step-wise layers as well as continuously graded. Continuous grading of functionally graded materials is accomplished by co-depositing powder mixtures in which the concentration of the admixture is varied as a function of coating thickness.

A combination of functionally formed and functionally graded materials is included in the invention. An example of this embodiment includes encapsulation of an inner core of material (e.g. metallic alloy, metallic foam, ceramic or composite) with a monolithic layer, functionally graded layer of materials, functionally formed in-situ composite or functionally formed ex-situ composites to tailor specific properties of the finished part or component.

Although the scope of the apparatus and process of this invention has been described in detail with particular reference to preferred embodiments, other embodiments can achieve the same results. Variations and modifications of the present apparatus and process of the invention will be obvious to those skilled in the art and it is intended to cover in the appended claims all such modifications and equivalence. The entire disclosures of all references, applications, patents, and publications cited above, and of the corresponding applications(s), are hereby incorporated by reference.

Wherefore, what is claimed is:

1. A powder fluidizing device, comprising:

a vibrating bowl structure comprising a powder receiving surface, a discharge conduit, and a feeding channel which provides a spiraling ramp along which powder moves up from the receiving surface in a lower part of the vibrating bowl structure to the discharge conduit in a upper part of the vibrating bowl and out of the powder fluidizing device through the discharge conduit;

a vibrating bowl vibration mechanism for imparting a rotational oscillation to the vibrating bowl which causes powder deposited onto the receiving surface to move along the feeding channel to the discharge conduit;

a powder hopper located above the vibrating bowl, said hopper comprising a reservoir of powder and a funnel tube extending down into the vibrating bowl to a point above the receiving surface; and a powder flow control mechanism for controlling the amount of powder that flows from the receiving surface to the discharge channel, wherein said second powder flow control mechanism is a feedback mechanism which determines the powder mass loss rate from the powder fluidizing device and adjusts the vibration mechanism to substantially maintain said loss rate at a prescribed value.

2. The device of claim 1, wherein the powder flow control mechanism comprises:

a mass sensor which outputs a signal indicative of the weight of the powder in the powder fluidizing device;

a computing device for computing the powder mass loss rate based on the change in the output signal from mass sensor; and a controller for controlling the vibrating bowl vibration mechanism so as to adjust the amount of rotational oscillation imparted to the vibrating bowl, and so the amount of powder moved to the discharge conduit and out of the powder fluidizing device, to substantially maintain said mass loss rate, as computed by the computing device, at a prescribed value.

3. The device of claim 2, wherein the vibrating bowl vibration mechanism controller comprises a PID feedback device which increases the amount of power supplied to the vibrating bowl vibration mechanism thereby increasing the intensity of the vibration imparted to the vibration bowl whenever the computed powder mass loss rate is substantially below said prescribed value, and which decreases the amount of power supplied to the vibrating bowl vibration mechanism thereby decreasing the intensity of the vibration imparted to the vibration bowl whenever the computed powder mass loss rate is substantially above said prescribed value.

4. The device of claim 1, wherein the feeding channel of the vibrating bowl structure is a groove, and wherein the vibrating bowl structure further comprises gate valve which protrudes into the groove at a point along its path to limit the amount of powder which can pass beyond the gate valve to prescribed amount per unit time.

5. The device of claim 4, wherein the gate valve comprises at least one rake finger extending down from the gate valve into the powder allowed to pass by the valve, wherein the rake finger or fingers break up agglomerated and clumping portions of the powder.

6. The device of claim 1, wherein discharge conduit is fixed to the vibrating bowl at a proximal end thereof and fixed to an outlet channel of the powder fluidizing device a the distal end thereof, and wherein the discharge tube is flexible so as to not interfere with the rotational oscillation of the vibrating bowl.

7. The device of claim 6, further comprising a pressure housing surrounding the a powder hopper, vibrating bowl structure, and associated components thereof, and wherein the pressure chamber is pressurized with a gas which exits through said outlet channel of the powder fluidizing device via the discharge conduit, thereby assisting in the flow of powder through the conduit.

8. The device of claim 1, further comprising a second powder flow control mechanism for controlling the amount of powder that flows from the funnel tube to the receiving surface.

9. The device of claim 8, wherein the second powder flow control mechanism comprises an upper sieve and a lower sieve, wherein the upper sieve is mounted within the powder hopper so as to meter powder in said reservoir which overlies the upper sieve onto the lower sieve which is mounted across an entrance to the funnel tube so as to meter powder into the funnel tube, and wherein the number, distribution and aperture size of the holes in each sieve restricts the amount of powder that can flow through the sieves and enter the funnel tube from the powder reservoir and are selected to control the amount of powder that flows into the funnel tube and so onto the receiving surface of the vibrating bowl.

10. The device of claim 9, wherein the upper sieve comprises two plates with substantially matching hole patterns which are rotatable in relation to each other and wherein the size of the aperture of each sieve hole is adjusted by rotating one of the plates in relation to the other, thereby controlling the degree to which the upper sieve restricts the flow of powder from the reservoir to the lower sieve.

11. The device of claim 9, wherein the lower sieve comprises two plates with substantially matching hole patterns which are rotatable in relation to each other and wherein the size of the aperture of each sieve hole is adjusted by rotating one of the plates in relation to the other, thereby controlling the degree to which the lower sieve restricts the flow of powder into the funnel tube.

12. The device of claim 8, wherein the second powder flow control mechanism further comprises a powder hopper vibration mechanism which vibrates the powder hopper so as to facilitate the flow of powder through the sieves.

13. The device of claim 12, wherein the second powder flow control mechanism further comprises:

a level sensor that senses the amount of powder residing on the receiving surface of the vibrating bowl and outputs a signal indicative of that amount; and a powder hopper vibration mechanism controller which controls the amount of vibration imparted to the powder hopper by the hopper vibration mechanism so as to control the amount of powder deposited onto the receiving surface of the vibrating bowl, as indicated by the level sensor, to approximately a prescribed amount.

14. The device of claim 13, wherein the level sensor comprises:

a flexible vane that deflects in proportion to the amount of powder residing on the receiving surface of the vibrating bowl; and a deflection sensor which detects the amount of deflection exhibited by the flexible vane and outputs a signal indicative thereof.

15. The device of claim 14, wherein the powder hopper vibration mechanism controller comprises a switch which turns the powder hopper vibration mechanism on when the deflection sensor indicates the deflection of the flexible vane is small enough to indicate an inadequate amount of powder exists on the receiving surface of the vibrating bowl, and which turns the powder hopper vibration mechanism off when the deflection sensor indicates the deflection of the flexible vane is large enough to indicate that an adequate amount of powder exists on the receiving surface of the vibrating bowl.

16. The device of claim 14, wherein the powder hopper vibration mechanism controller comprises a PID feedback device which varies the amount of power supplied to the powder hopper vibration mechanism in proportion to the deflection of the flexible vane as detected by the deflection sensor.

17. The device of claim 14, wherein the funnel tube comprises a cutout notch at its distal end adjacent the receiving surface and facing the flexible vane to preferentially accumulate powder in front of the vane.

18. A powder fluidizing device, comprising:

a vibrating bowl structure comprising a powder receiving surface, a discharge conduit, and a feeding channel which provides a spiraling ramp along which powder moves up from the receiving surface in a lower part of the vibrating bowl structure to the discharge conduit in a upper part of the vibrating bowl and out of the powder fluidizing device through the discharge conduit;

a vibrating bowl vibration mechanism for imparting a rotational oscillation to the vibrating bowl which causes powder deposited onto the receiving surface to move along the feeding channel to the discharge conduit;

a powder hopper located above the vibrating bowl, said hopper comprising a reservoir of powder overlying at least one sieve mounted within the powder hopper so as to meter powder in said reservoir to a funnel tube extending down into the vibrating bowl to a point above the receiving surface; and a powder flow control mechanism for controlling the amount of powder that flows from the funnel tube to the receiving surface, wherein said first powder flow control mechanism comprises a powder hopper vibration mechanism which vibrates the powder hopper so as to facilitate the flow of powder through the sieve or sieves.

19. The device of claim 18, wherein the powder flow control mechanism further comprises:

a sensor that senses the amount of powder residing on the receiving surface of the vibrating bowl and outputs a signal indicative of that amount; and a powder hopper vibration mechanism controller which controls the amount of vibration imparted to the powder hopper by the hopper vibration mechanism so as to control the amount of powder deposited onto the receiving surface of the vibrating bowl, as indicated by the sensor, to approximately a prescribed amount.

20. A powder fluidizing device, comprising:

a vibrating bowl structure comprising a powder receiving surface, a discharge conduit, and a feeding channel which provides a spiraling ramp along which powder moves up from the receiving surface in a lower part of the vibrating bowl structure to the discharge conduit in a upper part of the vibrating bowl and out of the powder fluidizing device through the discharge conduit;

a vibrating bowl vibration mechanism for imparting a rotational oscillation to the vibrating bowl which causes powder deposited onto the receiving surface to move along the feeding channel to the discharge conduit;

a powder hopper located above the vibrating bowl, said hopper comprising a reservoir of powder and a funnel tube extending down into the vibrating bowl to a point above the receiving surface;

a first powder flow control mechanism for controlling the amount of powder that flows from the funnel tube to the receiving surface;

a second powder flow control mechanism for controlling the amount of powder that flows from the receiving surface to the discharge channel; and a heating unit which heats the powder in the powder hopper reservoir to a temperature high enough to dissipate agglomeration and clumping of the powder.

* * * * *